United States Patent [19]

George

[11] 4,004,736

[45] Jan. 25, 1977

[54] ULTRASONIC WATER JET

[75] Inventor: Loyd William George, Renton, Wash.

[73] Assignee: The Boeing Company, Seattle, Wash.

[22] Filed: June 1, 1976

[21] Appl. No.: 691,960

[52] U.S. Cl. ..... 239/102; 239/4

[51] Int. Cl.[2] ..... B05B 17/06

[58] Field of Search ..... 239/4, 101, 102, 106, 239/499; 310/8.2, 8.3, 8.7; 259/DIG. 44

[56] References Cited

UNITED STATES PATENTS

| | | | |
|---|---|---|---|
| 2,512,743 | 6/1950 | Hansell | 239/4 X |
| 3,194,162 | 7/1965 | Williams | 239/102 X |
| 3,804,329 | 4/1974 | Martner | 239/4 |
| 3,899,130 | 8/1975 | Bell | 239/102 |
| 3,932,109 | 1/1976 | Pitcher et al. | 239/4 X |

FOREIGN PATENTS OR APPLICATIONS

| | | | |
|---|---|---|---|
| 2,312,442 | 10/1974 | Germany | 239/102 |

*Primary Examiner*—Robert S. Ward, Jr.
*Attorney, Agent, or Firm*—Conrad O. Gardner; Bernard A. Donahue

[57] ABSTRACT

An ultrasonic water jet having first and second housing members. The first housing member includes an interior exponentially shaped duct and a plurality of water inlets equiangularly displaced and circumferentially disposed about the central axis of the exponentially shaped duct for cleansing a face of the ceramic disk transducer clamped between the first housing member and an O-ring seated in the second housing member.

6 Claims, 4 Drawing Figures

ULTRASONIC WATER JET

This invention relates to water jets for ultrasonic inspection and more particularly to an ultrasonic water jet having a two section transducer mounting housing.

Prior art devices, e.g. as exemplified by U.S. Pat. No. 2,512,743 show jet spraying devices having transducer elements and an exponential duct.

German Pat. No. 710,653 is illustrative of water inlet means for angularly directing a flow of liquid to be atomized onto the face of a resonating atomizing plate, while U.S. Pat. No. 3,804,329 shows circumferential application of a plurality of water streams to the surface of a resonating plate. Also, U.S. Pat. No. 3,932,109 shows an ultrasonic burner having ultrasonic atomizing means which atomizes a liquid axially into an ejection passage.

It is accordingly an object of this invention to provide means including a two piece housing for forming a plenum chamber for water input and further mounting a disk type transducer element in line with an exponentially shaped nozzle duct in a manner providing for circumferential directions of a plurality of streams of water from the plenum chamber against a major surface area of the disk type transducer element to reduce water swirling and bubble formation at the aforementioned major surface of the disk type transducer.

It is a further object of this invention to provide means for generating a coherent water stream capable of propagating ultrasonic energy thereby minimizing ultrasonic energy loss due to stream break up.

It is yet another object of this invention to provide means including a two piece housing for clamping a disk shaped transducer across the inlet of an exponentially shaped nozzle duct of slightly lesser diameter than the face diameter of the disk shaped transducer thereby maximizing sound flow in the fluid transmitted through the exponentially shaped nozzle duct.

The foregoing and other objects and advantages of this invention will best be understood by the following detailed description of an embodiment thereof taken in view of the accompanying drawings, wherein.

Figure 3:
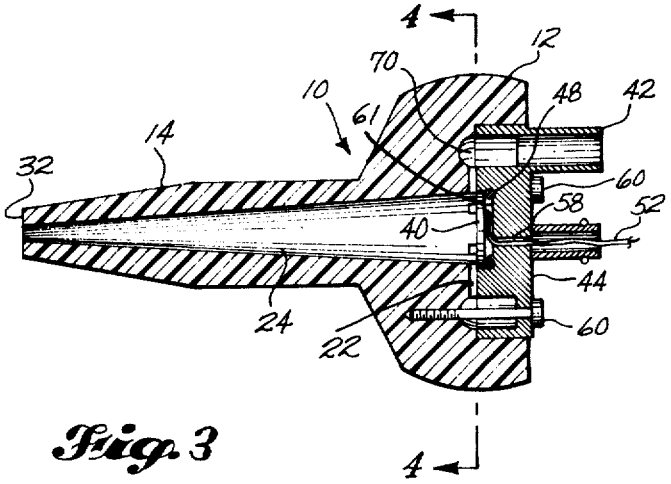
Figure 4:
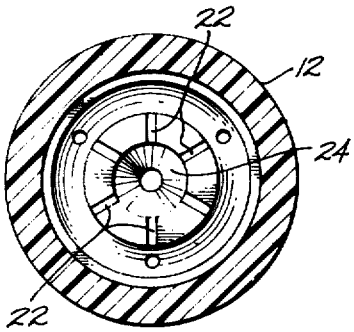

FIG. 3 is a side view in section detailing water flowing from inlet to outlet through plenum, circumferentially disposed radially extending water inlets against one side of a disk type piezo-electric transducer element and through an exponentially shaped duct; and, FIG. 4 is a cross sectional view taken in the direction of the line 4—4 of FIG. 3 showing in more detail the radially extending water inlets disposed as slots in the inner surface of the first housing member which extend from the plenum chamber into the wall of the exponentially shaped inner duct.

Figure 1:
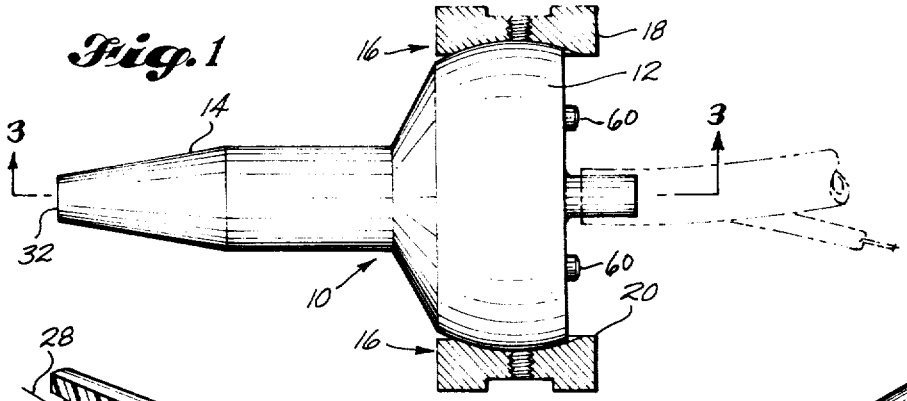
FIG. 1 is a side view including mounting assembly illustrative of a preferred embodiment of the integrated ultrasonic water jet.

Referring now in detail to the drawings, especially to FIG. 1 thereof, a first one-piece housing section 10 molded from plastic having a ball shaped end portion 12 formed at one end of the section 10 and a nozzle shaped end portion 14 formed at the other end thereof. Ball shaped end portion 12 is supported by a socket type mounting assembly 16 comprising a pair of clamping members 18 and 21 having concave inner surfaces with radii of curvature equal to the radius curvature of ball shaped end portion 12. Mounting assembly 16 permits ball joint mounting and support of first housing section 10 above a table (not shown) to accomodate the parts desired to be inspected while allowing rotation of nozzle shaped end portion 14 for scanning of parts.

Figure 2:
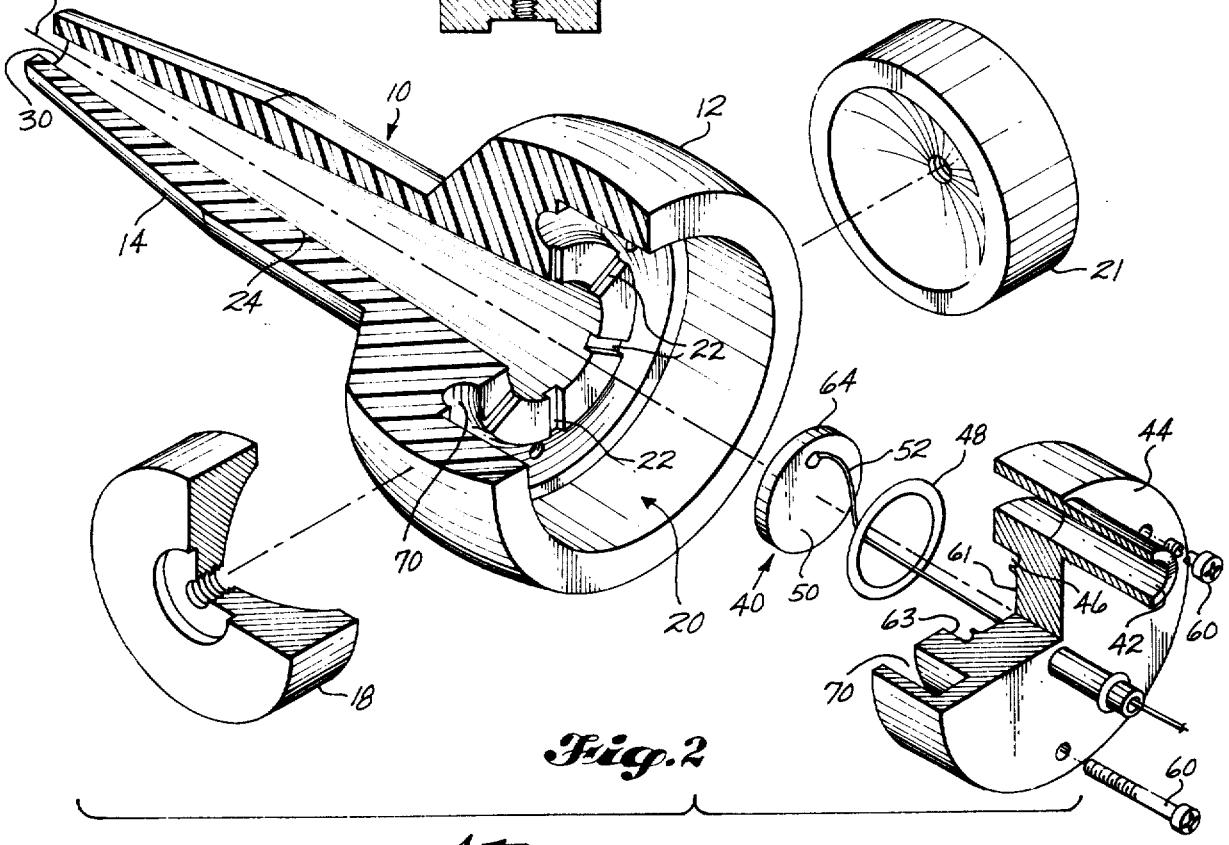
FIG. 2 is an exploded perspective view of the ultransonic water jet of FIG. 1 showing interrelationship of parts for assembly.

Turning now to FIG. 2, it will be noted that ball shaped end portion 12 has an inner cylindrically shaped volume 20 through which water is coupled via a plurality (e.g. six) of radially extending slots 22 formed in the bottom portion of volume.20 of plastic section 10 into exponentially shaped duct 24. Duct 24 is of circular cross section and coaxially disposed about the central axis 29 of section 10 and extends througn nozzle shaped end portion 14 to outlet 30 which corresponds to the ending diameter of duct 24. Nozzle shaped end portion 14 has a terminating end surface 32 (as seen in FIGS. 1 and 3) extending along a plane disposed at right angles to the water flow axis (central axis 28). Sharp termination of nozzle shaped end portion 14 by a planar surface in the aforementioned manner at 90° to the water flow axis 28 provided the least turbulent jet stream when compared to other geometrically shaped terminations of exponentially shaped duct 24.

Exponential duct 24 is provided with a shape in accordance with the following formula:

$$D_1/D_0 = BL$$

where:

$D_1$ = ending diameter at outlet 30.

$D_0$ = starting diameter at the bottom of inner cylindrically shaped volume 20.

$B$ = taper constant.

$L$ = length between the aforementioned starting and ending diameters.

With a piezo electric transducer 40 diameter of 0.750 inch positioned across the inlet or starting diameter of duct 24 of 0.690 inch, maximizing of sound flow in the transmitted through exponentially shaped nozzle duct 24. With this minimum of overlap provided by a difference in diameters of 0.060 inch or less, suitable mounting and maximum exposure of transducer 40 is provided. The ending diameter of duct 24 forming outlet 30 should be in the range of ⅛ inch to ½ inch where water pressure to input duct 42 of the ultrasonic water jet is between 1.6 and 3 psi. Within the above operating parameters, a 4 to 6 inch stiff stream is provided from outlet 30 during operation of the present utrasonic water jet device. It should be noted that input duct 42 is formed by soldering a small section of brass ducting to an aperture in semicylindrically shaped second housing member 44, also formed of brass. A coaxially disposed circular slot 46 is formed in the inside bottom portion of cylindrically shaped second housing member 44 to receive a compressible rubber O-ring which provides an electrically insulative and water tight support for the major surface 50 of transducer 40 in spaced apart relationship with the inside bottom portion 61 of housing member 44 (see FIG. 3). It should be noted that piezo electric transducer 40 has a first terminal lead wire 52 (electrically insulated) which passes through a channel 58 (see FIG. 3) passing through the bottom of brass housing member 44. The second electrical connection to the outer casing of transducer 40 is provided by electrical connection to the bottom outer surface of brass member 44 (as by connection to one of brass screws 60 which clamp the two piece housing and interior assembly of parts together as shown in FIG. 3). In this connection it can be seen that the outer edge 64 (see FIG. 2) of disk 40 is in direct physical and electrical contact with wall 63 of the interior bottom surface portion 61 of brass member 44 thereby providing an electrically conductive circuit path from the outer casing via peripheral edge 64 of transducer 40 to brass screws 60. Suitable ultrasonic energy (not shown) from an ultrasonic generator is then connected between wire 52 and screw 60 to cause piezo electric transducer 40 to vibrate in the manner readily understood by those skilled in the art. Upon assembly, as shown in FIG. 3, of electrically conducting second housing member 44 into the volume 20 of non electrically conducting (plastic) first housing member 10, O-ring 48 is compressed as screws 60 are tightened thereby providing a water tight air volume between major surface 50 of disk type transducer 40 and an inner surface region 60 (see FIG. 2) on the bottom of brass housing member 44. It should be noted also that the present ultrasonic water jet when in an assembled condition as shown in FIG. 3 provides water flow from a source (not shown) coupled to input duct 42 into a generally torroidally shaped plenum chamber 70, then through a plurality of radially extending slots 22 into exponentially shaped duct 24 by way of the major surface of disk 40 facing duct 24 inlet, and via outlet 30 in the form of hereinbefore mentioned 4 to 6 inch stiff stream (stiff meaning generally unbroken and free of bubbles).

What is claimed is:

1. An ultrasonic water jet comprising in combination:

a first non electrically conductive housing section having an interior exponentially shaped duct;

a second electrically conductive housing section having a circular slot;

a non electrically conductive O-ring disposed in said circular slot;

a plurality of equiangularly displaced slots in said first non electrically conductive housing section circumferentially disposed about the central axis of said exponentially shaped duct; and, a disk shaped piezo electric transducer disposed along said central axis between said slots and said non electrically conductive O-ring.

2. An ultrasonic water jet according to claim 1 wherein said first non electrically conductive housing section includes nozzle portion having an end portion including a planar surface disposed at right angles to said central axis.

3. An ultrasonic water jet according to claim 2 wherein said end portion has an inner water outlet having a diameter of between ⅝ and ½ inch.

4. An ultrasonic water jet according to claim 2 wherein said first non electrically conductive housing section has a ball shaped end portion formed at the end thereof opposite said nozzle portion thereby enabling ball and socket mounting of said water jet to facilitate scanning of parts.

5. An ultrasonic water jet according to claim 1 wherein said non electrically conductive housing section comprises molded plastic having a polished internal surface.

6. In combination in an ultrasonic water jet:

a first non electrically conductive housing section having an interior exponentially shaped duct;

a second electrically conductive housing section;

a disk shaped piezo electric transducer concentrically disposed about the central axis of said exponentially shaped duct;

a plurality of water inlets disposed about the central axis of said exponentially shaped duct, said water inlets arranged to direct a corresponding plurality of streams of water against a major surface area of said disk shaped piezo electric transducer thereby reducing water swirling and bubble formation at said major surface area of said disk shaped piezo electric transducer.

* * * * *